US005251575A

United States Patent [19]

Michel

[11] Patent Number: 5,251,575

[45] Date of Patent: Oct. 12, 1993

[54] INSTALLATION FOR COOLING HOT, DUST-CHARGED GAS IN A STEAM GENERATOR, AND A PROCESS FOR OPERATING SAID INSTALLATION

[75] Inventor: Roland Michel, Kreuzlingen, Switzerland

[73] Assignee: Sulzer Brothers Limited, Winterthur, Sweden

[21] Appl. No.: 877,569

[22] Filed: May 1, 1992

[30] Foreign Application Priority Data

Jun. 12, 1991 [CH] Switzerland ..... 01753/91

[51] Int. Cl.[5] ..... F22D 1/00

[52] U.S. Cl. ..... 122/7 R; 48/67; 48/77; 55/267; 122/32

[58] Field of Search ..... 122/7 R, 32, 33; 48/77, 48/67; 55/267, 268, 269

[56] References Cited

U.S. PATENT DOCUMENTS 4,270,493 6/1981 Blaskowski ..... 122/7 R
4,377,132 3/1983 Koog et al. ..... 122/7 R
4,493,291 1/1985 Zabelka ..... 122/7 R

FOREIGN PATENT DOCUMENTS 0366606 5/1990 European Pat. Off. .
2948201 6/1981 Fed. Rep. of Germany .
3618268 12/1987 Fed. Rep. of Germany .

*Primary Examiner*—Edward G. Favors
*Attorney, Agent, or Firm*—Townsend and Townsend Khourie and Crew

[57] ABSTRACT

The installation comprises a steam generator, which consists of a first heat exchanger (50) and two second heat generators (53, 54). The first heat exchanger (50) is a radiant heat exchanger, in which the temperature of the hot gas coming from a reactor (52) is lowered to a temperature beneath the softening point of the dust. The second heat exchangers (53, 54) are convection heat exchangers, which are connected after downstream of the first heat exchangers (50) in the gas flow and are connected in parallel to one another. In the gas flow downstream of each second heat exchanger (53, 54) is a shut-off device (61 and 62).

6 Claims, 3 Drawing Sheets

4
14
14
15
27
11
27
56
50
6
5
10
8
54
7
9
23
18
3
17
9
5
8
3
17
18
22
13
12
16
1
60
62

INSTALLATION FOR COOLING HOT, DUST-CHARGED GAS IN A STEAM GENERATOR, AND A PROCESS FOR OPERATING SAID INSTALLATION

BACKGROUND OF THE INVENTION

The invention relates to an installation for cooling hot, dust-charged gas in a steam generator, which consists of a first radiant heat exchanger and a second convection heat exchanger. In such installations the gas coming from the reactor is normally cooled in the radiant heat exchanger to a temperature below the softening point of the dust. When the gas enters into the convection heat exchanger, the dust particles are no longer sticky and can no longer become caked together on the effective heating surfaces of this heat exchanger. However the dust particles can become deposited in the tightly disposed heating surfaces of the convection heat exchanger and form blockages, so that the transfer of heat from the gas to the heating surfaces is impaired.

SUMMARY OF THE INVENTION

An object of the invention is to improve an installation of the aforementioned type so that it is possible to remove the dust particles deposited in the convection cooler in a simple way both by structural means and also by operational means.

This object is achieved with the invention in that at least two second heat exchangers are connected behind the radiant heat exchanger in the gas stream and are connected in parallel to one another and in that a shut-off device is disposed in the gas stream behind every second heat exchanger.

As a result, it becomes possible to throttle or shut a shut-off device so that the flow velocity of the gas in the other convection heat exchanger rises so that the dust deposits in this heat exchanger are discharged. Despite this increase in flow velocity, the permissible heat flux density in this heat exchanger is not exceeded. Thus the convection heat exchangers are cleaned in sequence by the cyclical throttling or closing of the shut-off device.

The installation of the present invention is particularly advantageous if more than two convection heat exchangers connected to the radiant heat exchanger. In this configuration different circuits, on the side of the working fluid, are created for the convection heat exchangers by, for example, a part of the convection heat exchangers being connected for use as economizers, or as economizers and vaporizers, and the remaining convection heat exchangers being connected for use as superheaters. In such a case the installation can also continue to operate if, for example, a superheater and/or an economizer breaks down because of a malfunction. In such a case the shut-off device is then closed behind the respective convection heat exchanger so that gas no longer flows through this heat exchanger. A further advantage of the invention is that inspections are possible on individual convention heat exchangers, while the rest of the installation continues to operate. The shut-off device located behind the convection heat exchanger to be inspected is then shut so that the inspection work can be carried out after the heat exchanger has cooled down.

The term "radiant heat exchanger" is understood to include heat exchangers in which a so-called quenching occurs, i.e. that gas which has already been cooled is returned into the first heat exchanger, which is a measure known per se.

Exemplified embodiments of the invention are explained in more detail in the following description by means of the drawings.

DESCRIPTION OF THE PREFERRED EMBODIMENTS

Figure 1:
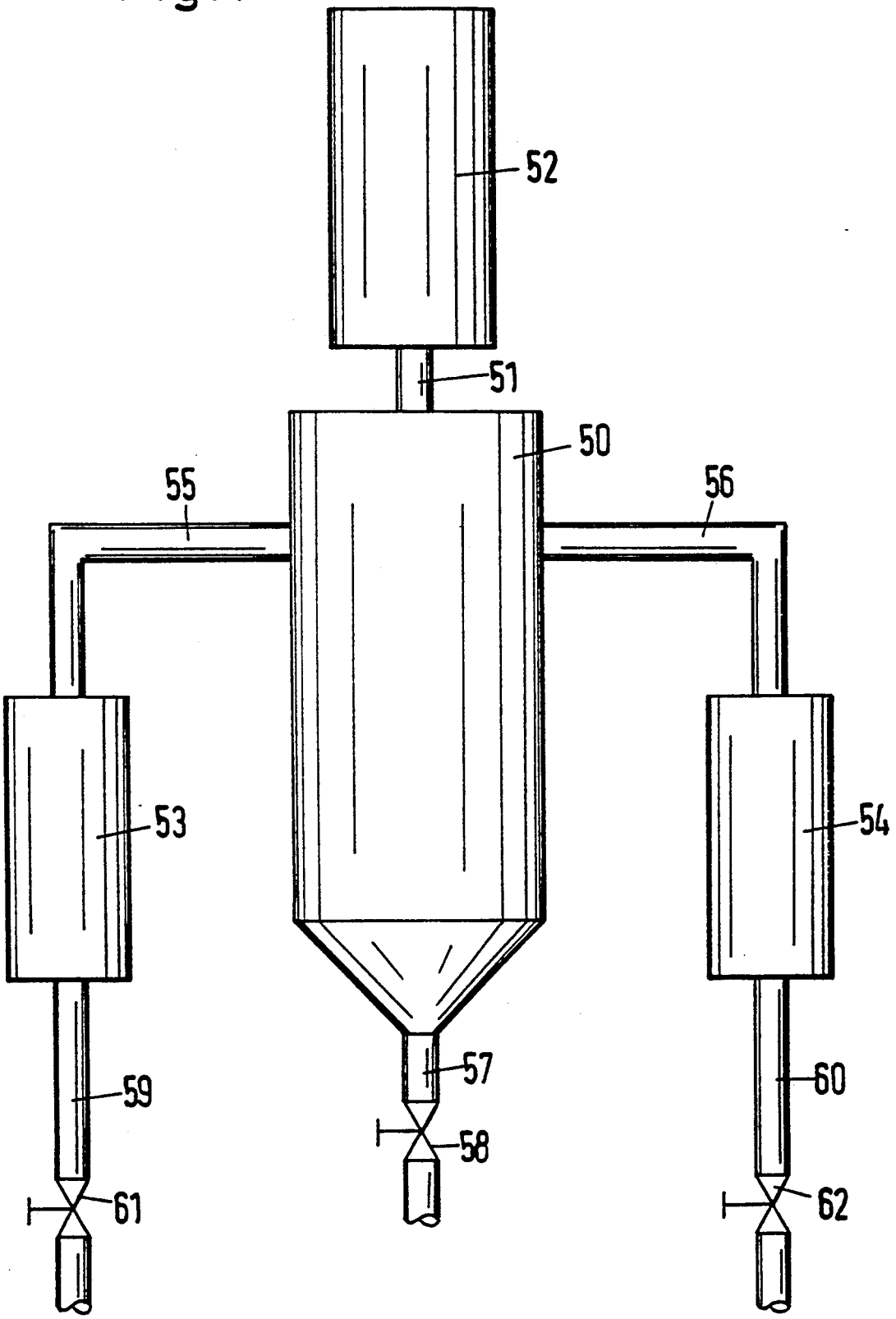
FIG. 1 shows a diagrammatic view of an installation for cooling hot, dust-charged gas.

As shown in FIG. 1, the installation comprises a first heat exchanger 50, which at its upper end in FIG. 1 is connected via a line 51 to a reactor 52, in which hot, dust-charged gas is produced in a known manner, e.g. by the gasification of coal. In the upper region of the first heat exchanger 50 second heat exchangers 53 and 54 are connected, via a line 55 and 56, respectively. To the lower end of the first heat exchanger 50 there is connected a line 57 having a shut-off device 58, via which solids separated in the heat exchanger 50, such as dust, ash and slag, can be drained together with water when the shut-off device 58 is opened. To the lower end of the second heat exchangers 53 and 54 shown in FIG. 1 there is connected a line 59 and 60, respectively, each having a shut-off device 61 and 62, respectively.

When the installation is operating normally, hot gas produced in the reactor 52 and having a temperature of 1400° to 1600° C. and a pressure of roughly 40 bar is supplied via line 51 to the first heat exchanger 50, in which it is substantially cooled by the transfer of radiant heat in contact with the working fluid of a steam generator until its temperature is beneath the softening point of the dust conveyed thereby. The solidified dust is mainly collected in the lower part of the heat exchanger 50, while the gas travels on via lines 55 and 56 to the second heat exchangers 53 and 54 for further cooling. Here the exchange of heat occurs by convection also in contact with the working fluid of the steam generator, after which the cooled gas leaves the installation via lines 59 and 60, as the shut-off devices 61 and 62 are completely open.

Figure 2:
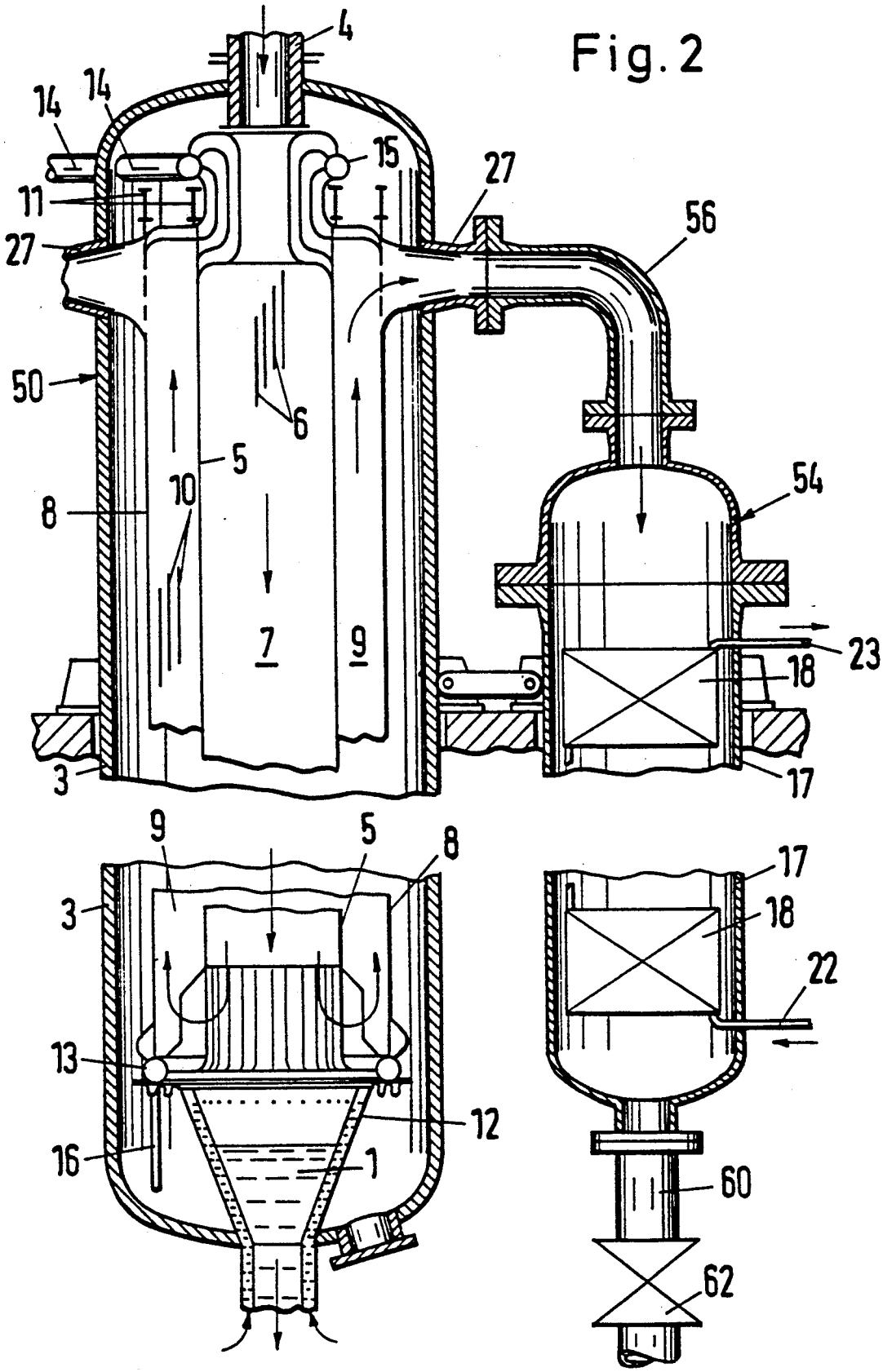
FIG. 2 shows a diagrammatically simplified vertical section through a radiant heat exchanger and a convection heat exchanger.

The general design of the effective heating surfaces of the steam generator contained in the heat exchangers 50, 53 and 54 is shown in FIG. 2.

As shown in FIG. 2, the first heat exchanger 50 has a cylindrical pressure vessel 3 with a vertical axis, which is penetrated at its upper end by a gas supply duct 4, which is connected to the coal gasification reactor 52 via the line 51, which is not shown in further detail here. Coaxially to and inside the pressure vessel 3 there is provided an insert 5, which is formed by vertical pipes 6 which are close together and are welded so they are gas-tight and which encloses a first gas flue 7 through which the hot gas flows from top to bottom. The insert 5 is surrounded by a shroud 8, which is also formed from vertical pipes 10, which are welded tightly together like a diaphragm wall. The shroud 8 surrounds the insert 5, but there is a clearance between them so that there is an annulus 9 through which gas flows from the bottom to the top and which forms a second gas flue. In comparison with the first gas flue 7, the cross section of flow in the second gas flue 9 is chosen so that a deceleration of the flow velocity is produced in the second gas flue 9.

The pipes 6 of the insert 5 and the pipes 10 of the shroud 8 are connected at their lower and upper ends to ring collectors 13 and 15, respectively. Feed-water, which evaporates as it flows through the pipes and is carried away from the upper collector 15 via a line 14, is supplied to the collector 13 via a line 16.

The pipes 6 and 10 of the insert 5 and of the shroud 8, respectively, are suspended near their upper ends on a girder system consisting of sectional girders 11, so that they can extend freely in the downward direction. Beneath the lower collector 13 there is provided a funnel 12 which tapers in the downward direction and pierces the base of the pressure vessel 3. This funnel 12 is partially filled with water and forms a water bath 1. The water bath serves to collect ash and slag particles which are carried along by the flow of hot gas and are centrifuged from the first gas flue 7 into the second gas flue 9 when the flow of hot gas is deflected.

Figure 3:
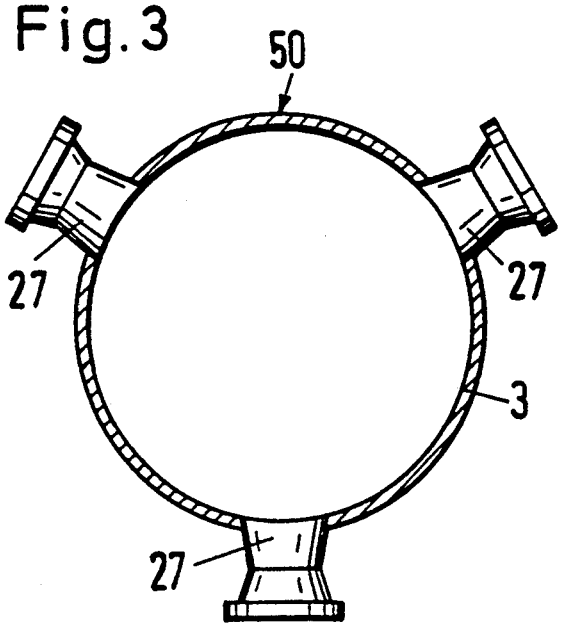
FIG. 3 shows a cross section through the pressure vessel of the radiant heat exchanger.

In the upper region of the pressure vessel 3 there are three pipe unions 27 (FIG. 3), to which the lines 55, 56 leading to the second heat exchangers 53 and 54 are connected. Thus the entire installation contains three convection heat exchangers. Each of the heat exchangers 53, 54 also has a pressure vessel 17 with a vertical axis, which is provided with bundles of cooling pipes 18 inside it. At the lower and upper end the bundles of pipes 18 are connected to a line 22 or 23, respectively, via which the feed-water is supplied and preheated or vaporized working fluids are removed.

After the gas has been further cooled when flowing through the bundles of pipes 18, it leaves the installation via lines 59 and 60 when the shut-off devices 61 and 62 are open. By adjusting the shut-off devices 61 and 62 so that their passage area is greatly reduced or is zero, the gas stream can be throttled or baffled in the two second heat exchangers 53 and 54 connected in series and the flow velocity can be simultaneously increased in the third convection heat exchanger, which is not shown in further detail. As a result of this increase in the flow velocity of the gas, the third unthrottled heat exchanger can then be cleaned by particles of gas deposited between the pipes of the pipe bundle 18 being entrained with the gas. In a similar way an increase in the gas flow velocity in the convection heat exchanger 53 can be produced by throttling and baffling the third convection heat exchanger and for example the convection heat exchanger 54, so that it is then cleaned. The same applies for the convection heat exchanger 54 when throttling the convection heat exchanger 53 and the third convection heat exchanger. After the end of the appropriate cleaning phase, the shut-off devices of the two other convection heat exchangers are again returned to the normal open position.

Figure 4:
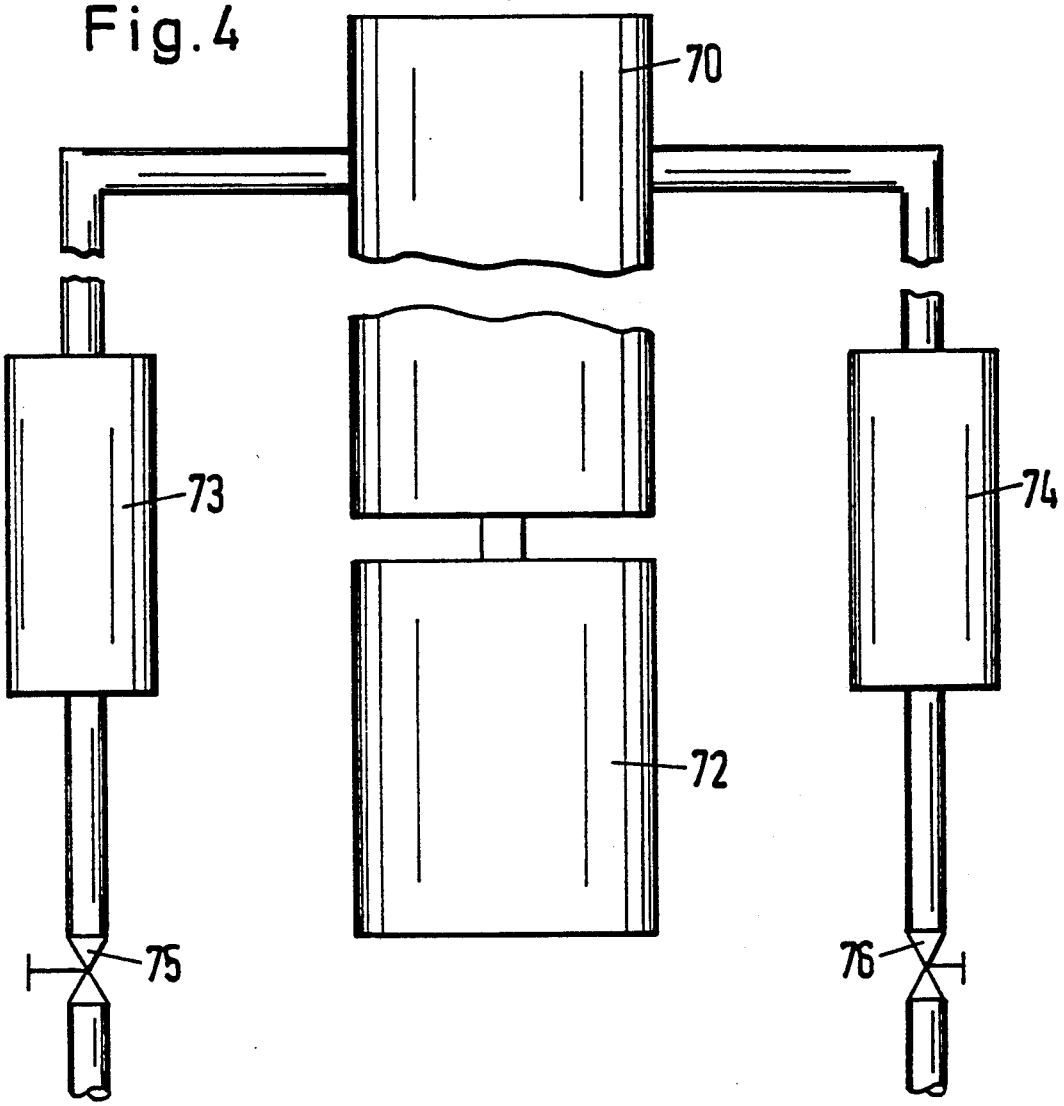
FIG. 4 shows a diagrammatic view of a modified installation.

In the exemplified embodiment shown in FIG. 4, the arrangement of the reactor and the first heat exchanger is reversed by the gasification reactor 72 being disposed beneath the first heat exchanger 70. As there is no deflection of the flow of the hot gas with this heat exchanger, its overall length is accordingly greater, so that the hot gas is cooled down to a temperature beneath the softening point, before it is conveyed to the convection coolers 73 and 74. The arrangement of the shut-off devices 75 and 76 behind the convection coolers 73 and 74 corresponds to that of the shut-off devices 61 and 62, and the actuation of the shut-off devices 75, 76 for the purpose of cleaning the coolers 73, 74 also corresponds to the actuation of the shut-off devices 61 and 62 already described.

The number of convection coolers per installation is at least two, but it may exceed this number.

I claim:

1. An installation for a cooling hot, dust-charged gas flow from a reactor, which is under a pressure of more than 1 bar, comprising a steam generator including a first heat exchanger receiving the hot gas flow coming from the reactor for lowering the temperature of the hot gas flow to a temperature below the softening point of the dust in the gas flow, at least two second heat exchangers connected in the gas flow downstream of the first heat exchanger and in parallel to one another for lowering the temperature of the gas flow by convention, and a shut-off device disposed in the gas flow downstream of each second heat exchanger.

2. An installation according to claim 1, wherein the reactor is disposed above the first heat exchanger.

3. An installation according to claim 1, wherein the first heat exchanger has a pressure vessel including a cylindrical insert comprising adjacent pipes welded gas-tight to each other and a shroud surrounding said insert made from adjacent pipes, and means directing the gas flow coming from the reactor through the insert from a top thereof to a bottom thereof and thereafter through a space between the insert and the shroud from the bottom to the top.

4. An installation according to claim 1 wherein the reactor is disposed beneath the first heat exchanger and the gas flow coming from the reactor flows through the first heat exchanger from a bottom thereof to a top thereof.

5. An installation according to claim 3, wherein each of the second heat exchangers also has a pressure vessel including at least one bundle of pipes forming heating surfaces for the steam generator, the gas flow coming from the first heat exchanger flowing past the bundle of pipes from a top thereof to a bottom thereof.

6. A method for operating an installation for cooling a hot, dust-charged gas flow from a reactor, which is under a pressure of more than 1 bar, the installation including a steam generator with a first heat exchanger receiving the hot gas flow for lowering its temperature to a temperature below the softening point of the dust in the gas flow, at least two second heat exchangers connected in the gas flow downstream of the first heat exchanger and in parallel to one another for lowering the temperature of the gas flow by convection, and a shut-off device disposed in the gas flow downstream of each second heat exchanger, the method comprising the steps of opening one shut-off device while closing the other shut-off device to thereby produce an increase in the flow velocity of the gas in the convention heat exchanger upstream of the shut-off device which is in the open position.

* * * * *